United States Patent [19]

Imhof et al.

[11] Patent Number: 4,693,069

[45] Date of Patent: Sep. 15, 1987

[54] DOUBLING MACHINE

[75] Inventors: Christian Imhof, Oerlingen; Gerhard Kempf, Arbon, both of Switzerland

[73] Assignees: Sulzer Brothers Ltd., Winterthur; Carl Hamel Spinn-& Zwirnmaschine AG, Arbon, both of Switzerland

[21] Appl. No.: 903,552

[22] Filed: Sep. 3, 1986

[30] Foreign Application Priority Data

Sep. 13, 1985 [CH] Switzerland ..... 3963/85

[51] Int. Cl.[4] ..... D01H 1/16; D01H 7/18; D01H 13/28

[52] U.S. Cl. ..... 57/59; 57/1 R; 57/304; 57/308; 242/128

[58] Field of Search ..... 57/59–65, 57/304–306, 1 R, 308; 242/128

[56] References Cited

U.S. PATENT DOCUMENTS 4,129,979 12/1978 Hamel ..... 57/59

*Primary Examiner*—John Petrakes

*Attorney, Agent, or Firm*—Kenyon & Kenyon

[57] ABSTRACT

A heat-insulating jacket extends around each rotating can of a doubling machine. Half way up the height of the can envelope surface, an extraction line for extracting the air heated by friction as the can rotates extends into the interior between the jacket and the can. The end-face boundaries of the rotating can and/or top and bottom closure members of the jacket are such that the pressures of the air drawn into the jacket are at least substantially equal at the top and at the bottom.

12 Claims, 1 Drawing Figure

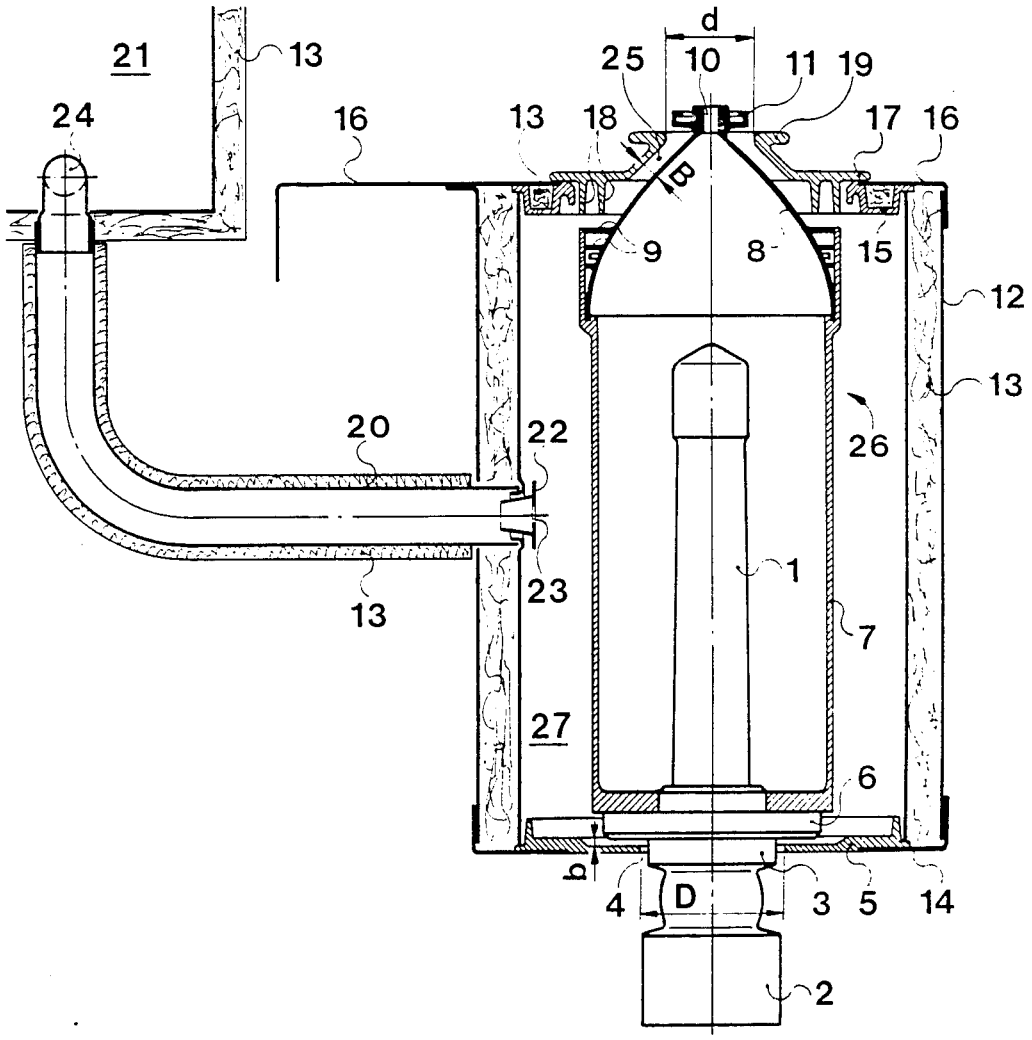
21
13
24
16
13
18
25
10
d
11
19
17
16
B
9
8
15
12
13
26
20
22
23
13
1
7
27
6
h
4
D
3
5
14
2

DOUBLING MACHINE

This invention relates to a doubling machine. More particularly, this invention relates to a doubling machine having means for cooling a rotation can.

Heretofore, various types of doubling machines have been known in which the unwinding of yarn takes place. Generally, the machines have been constructed with a spindle for receiving a feed bobbin, a can which is mounted about the spindle to rotate with the spindle and a stationary jacket which is disposed around and at a distance from the can and which is substantially closed at each end. In such cases, heat is generated during an unwinding operation in and about the cans. Since heat development can be a detriment to the yarn and/or unwinding operation, it has been known, for example from U.S. Pat. No. 4,129,979. to provide for the cooling of the rotating cans. To this end, an air extractor assembly has been connected to each jacket in order to withdraw air from within the jacket during rotation of a can. However, the trend to high spindle speeds, which now range up to as high as 17,000 rpm, demands increasingly stringent requirements on the drive and requires a very effective cooling of the bobbin receiving cans. Both of these factors increase total power consumption.

Accordingly, it is an object of the invention to considerably reduce the energy consumption of high speed doubling machines.

It is another object of the invention to provide a relatively efficient technique for cooling the rotating cans of a yarn doubling machine.

Briefly, the invention is directed to the doubling machine which includes a plurality of stations each of which includes a spindle for receiving a feed bobbin, a stationary jacket concentrically about the spindle to define a chamber, a can mounted on the spindle and disposed within the jacket and an air extraction line connected to the jacket and communicating with the chamber. In accordance with the invention, at least the envelope surface of the jacket is heat-insulated and the air extraction line is connected centrally of the jacket. In addition, means are provided for drawing air into the chamber at each end at substantially equal pressure for cooling of the can and to maintain a substantially equal temperature over the height of the can.

The means for drawing air into the chamber defined by the jacket includes a bottom closure member secured to the jacket and spaced from the spindle to define a first passage for an inflow of air as well as a top closure member secured to the jacket and spaced from an upper end of the can in order to define a second passage for the inflow of air. In accordance with the invention, these passages are sized relative to each other in order to equalize the pressure of air drawn in through the passages during rotation of the can.

One advantage provided by the above structure is a considerable reduction in the energy consumption for cooling since only a very reduced quantity of air is necessary for cooling. This is due to the effect of equalizing the pressures at the top and bottom of the can. In this regard, the closure members serve as end-face boundaries for the rotating can and are operative as "fans". Further, by arranging for the extraction of the air centrally of the height of the jacket, cooling is substantially the same throughout the height of the can. Consequently, the temperature throughout the jacket can be maintained substantially at the same value.

Therefore, if this temperature must not exceed an upper limit, the uniformity of temperature enables this result to be achieved with a very reduced quantity of air.

Of note, the frictional heat produced by the spindles or rotating cans of the doubling machine do not disturb the working environment, that is, the machine room and the usual air conditioning facilities associated with the room. Instead, this heat is removed directly with the extracted air at the place where the heat arises. The net energy consumption of the machine is further reduced if this waste heat is used for some purpose, such as, process water heating and/or room heating.

In order to equalize the pressures accurately for a particularly very high spindle speed, the width of the passage between the end-face boundaries of the rotating cans and the stationary closure members of the jacket can be varied and/or the diameter differences between the outer diameters of the end-face boundaries and the passages bounded by the closure members—and therefore, the "rotor size of the fans"—can be varied. Alternatively, the "fan blading" can be varied by varying the surface texture of the end-face boundaries. The main factor determining the absolute speed value at which equalization is effected is the nature of the yarn being processed, with economic criteria a secondary consideration.

Advantageously, for heat recovery, the air extraction lines of the various jackets extend to a common central extraction main which can extend lengthwise in the machine. If the various air extraction lines have adjustable restrictions of different cross-section, the suction effects for all the jackets of the machine can be equalized. Further the extraction mains of a number of machines can be combined in a single main comprising, for example, a heat exchanger for heat recovery .

Conveniently, to satisfy the requirement of maintaining the maximum jacket temperature at an upper limit with minimum air throughput, the quantities of air extracted are variable in dependence upon the temperature in the interior of the jackets. The following procedure has been found appropriate in this case:

A spindle temperature permissible in respect of the textile material is determined for a maximum permissible machine room temperature. The difference between these two temperatures gives a $\Delta t$. On the basis of all the $\Delta t$ values permissible for the yarns, the values for the volume of air to be extracted per spindle—at various speeds and with given can shapes and sizes as parameters—are determined in a diagram on which the $\Delta t$ values are plotted as ordinate and the air volumes are plotted as abscissa. If the shape or size of the can and/or the speed alter, there is a shift from one curve of the $\Delta t$/air volume per spindle family to another on which a different volume of air is associated with the same $\Delta t$ value. The quantity of air to be extracted is readjusted accordingly, for example, by means of a valve or flap facility in the suction main and/or control of extractor fan speed. The diagram referred to is arrived at empirically.

These and other objects and advantages of the invention will become more apparently from the following detailed description taken in conjunction with the accompanying drawing wherein:

The FIGURE diagrammatically illustrates a cross sectional view through a can and jacket of a doubling machine constructed in accordance with the invention.

Referring to the drawing, the doubling machine is composed of a plurality of stations each of which includes a spindle 1 for receiving a feed bobbin (not shown). Each spindle 1 is disposed on a wharve 2 which is rotatably mounted in known manner on a pin (not shown) and driven by way of a known belt drive (not shown) which engages in a convex zone. In addition, the wharve 2 widens above the convex zone to form a widened flange 3 which, in turn, widens upwardly to form a base 6 on which the spindle 1 is mounted.

A can 26 is mounted on the spindle 1 and includes a lower receiving part 7 which is mounted on the base 6 of the flange 3. At the upper end, the part 7 has a step or shoulder on which a cover 8 is placed. As indicated, the cover 8 has external centering ribs 9 for centering the cover 8 in the part 7 when the can 26 rotates. The cover 8 is of dome shape and has a yarn exit aperture 10 at the center about which a boss 11 extends.

A stationary jacket 12 is disposed concentrally about the spindle 1 in order to define a chamber 27. As indicated, the jacket 12 is double-walled with a filling of heat insulation 13 between the walls. In addition, an air extraction line 20 is connected to the jacket 12 and communicates with the chamber 27 centrally thereof, i.e. at about the center of the height of the jacket 12. This extraction line 20 extends to a central extraction main 21 which is connected in common to each of the extraction lines 20 of the various stations. As shown, a readily replaceable insert 22 is inserted into the line 20. Each insert 22 is formed with a continuous bore 23 to function as a restrictor for the air leaving the chamber 27. Of note, each restrictor 22 is selected from a set of restrictors each of which has a bore of a different diameter in order to provide for an adjustment of the restriction. These restrictors are thus adapted to provide for equalization between the quantities of air extracted through the various extraction lines 20 of a doubling machine.

The exit end of the extraction line 20 which, for example, is in the form of a flexible hose, is provided with an elbow 24 for deflecting the extracted air towards the air flow in the main 21. As also shown, insulation 13 thermally insulates the extraction line 20 and the main 21 from the ambiant atmosphere.

A means is also provided for drawing air into the chamber 27 at each end at substantially equal pressure for cooling of the can 26 and to maintain a substantially equal temperature over the height of the can 26. This means includes a bottom closure member 5 which is peripherally secured to the jacket 26 and which has an opening spaced from the flange 3 to define a passage 4 for an inflow of air into the chamber 26. As indicated, the closure member 5 has an opening of a diameter D which is larger than the flange 3. As shown, the closure member 5 has a central recess which receives the widened base 6 of the flange 3 and is spaced therefrom a distance b to form a gap for the inflow of air. The bottom closure member 5 is made of a material such as plastic which is a poor heat conductor and is secured to the jacket 12 by means of a cover plate 14. The closure member 5 thus serves as a bottom axial closure of the jacket 12.

In a similar fashion, a top closure member is located at the top of the jacket 12. This top closure member includes a U-shaped ring 15 which rests on the jacket 12 and which is filled with insulation 13, a cover plate 16 which secures the ring 15 to the jacket 12 and a closure cover 17 which is mounted on the ring 15. As indicated, the cover 17 has inwardly extending ribs 18 which are disposed opposite to the ribs 9 on the cover 8 of the can 26. The cover 17 extends concentrically around the cover 8 to define a passage for the inflow of air and, in particular, an annular gap of a width B. The cover 17 also has a a boss 19 at the upper end which serves as a hand grip. The inlet opening of the cover 17 is of a diameter d which is greater than the boss 11 on the cover 8.

The cover 8 with the ribs 9 and the base 6 form the end-face boundaries of the can 26. These boundaries serve as "fans" to intake air from the atmosphere through the passages between the bottom closure member 5 and the flange 3 and between the covers 8, 17 in order to deliver the air into the interior chamber 27 of the jacket 12.

In order to equalize the pressures at the exit or outlet of the "fans", i.e. in the peripheral zones of the top and bottom closure members, the diameters D, d of the passages 4, 25, respectively are sized relative to each other to equalize the pressure of air drawn in through the passages during rotation of the can 26. When changing the diameters D, d, an alteration in the "rotor sizes" of the fans is produced.

Alternatively, the gap widths B, b between the covers 8, 17 and the closure member 5 and flange 3 may be varied.

Another possibility is to restrict the flow of the top "fan" by variations in the spacing between the ribs 18, 9. Also, the surface textures of the "rotors" may be varied.

Pressure equalization is determined experimentally for each size and shape of can used at at least one very high speed for the kind of yarn to be processed since energy consumption and the evolution of heat are greatest at high speeds. Once determined, the sizes of the bottom closure member 5 and cover 17 can be chosen to bring about pressure equalization during use. In addition, a suitably sized insert 22 can be selected for the air extraction line 20.

While only one unwinding station has been illustrated, it is to be understood that a plurality of stations are to be employed in the doubling machine. Further, where each station is occupied by a can of the same size and shape, the various passages are sized in the same manner. However, should the cans at different stations be of different sizes, the passage would be suitably dimensioned so as to achieve pressure equalization.

The invention thus provides a relatively simple technique for cooling the rotating cans of a doubling machine at a minimal of energy consumption.

What is claimed is:

1. In combination, a spindle for receiving a feed bobbin;

a wharve having a flange for mounting of said spindle thereon;

a stationary heat insulating jacket disposed concentrically about said spindle to define a chamber;

a bottom closure member peripherally secured to said jacket and spaced from said flange to define a first passage therebetween for a flow of air;

a can mounted on said spindle and said flange and disposed within said jacket;

a top closure member peripherally secured to said jacket and spaced from an upper end of said can to define a second passage therebetween for a flow of air;

an air extraction line connected to said jacket and communicating with said chamber centrally of said closure members to exhaust air therefrom; and wherein said passages are sized relative to each other to equalize the pressure of air drawn through said passages into said chamber during rotation of said can.

2. The combination as set forth in claim 1 wherein said first passage is a gap between said flange and said bottom closure member and said second passage is an annular gap between said can and said top closure member.

3. The combination as set forth in claim 1 wherein said bottom closure member has an opening about said flange of a first passage and said top closure member has an opening about said can of a second diameter to define said second passage.

4. The combination as set forth in claim 1 which further comprises a selected one of a plurality of restrictors having bores of different diameters in said air extraction line.

5. The combination as set forth in claim 1 which further comprises a central extraction main connected to an outlet of said air extraction line.

6. In combination a spindle for receiving a feed bobbin;

a wharve having a flange for mounting of said spindle thereon;

a stationary heat insulating jacket disposed concentrically about said spindle to define a chamber having one end at said wharve and a second opposite end;

a can mounted on said spindle and said flange and disposed within said jacket;

an air extraction line connected to said jacket and communicating with said chamber centrally thereof; and means for drawing air into said chamber at each end at substantially equal pressure for cooling of said can and to maintain a substantially equal temperature over the height of said can.

7. The combination as set forth in claim 6 wherein said means includes a bottom closure member secured to said jacket and spaced from said flange to define a first passage therebetween for an inflow of air and a top closure member secured to said jacket and spaced from an upper end of said can to define a second passage therebetween for an inflow of air.

8. The combination as set forth in claim 7 wherein said passages are sized relative to each other to equalize the pressure of air drawn in through said passages during rotation of said can.

9. The combination as set forth in claim 7 wherein said can includes a cover at said upper end and a plurality of external ribs on said cover on one side of said second passage and wherein said top closure member includes a plurality of inwardly extending ribs opposite said ribs on said cover.

10. The combination as set forth in claim 6 which further comprises an adjustable air restrictor in said air extraction line.

11. A doubling machine comprising a plurality of spindles;

a plurality of wharves, each wharve having a flange for mounting a respective spindle thereon;

a plurality of stationary heat insulating jackets, each jacket being disposed concentrically about a respective spindle to define a chamber having one end at each wharve and a second opposite end;

a plurality of cans, each can being mounted on a respective spindle and disposed within a respective jacket;

a plurality of air extraction lines, each line being connected to a respective jacket and communicating with said chamber therein centrally thereof; and means for drawing air into each respective chamber at each end thereof at substantially equal pressure for cooling of said can therein.

12. A doubling machine as set forth in claim 11 which further comprises a central extraction main connected in common to each of said extraction lines.

* * * * *